US010424261B2

(12) United States Patent
Wang et al.

(10) Patent No.: US 10,424,261 B2
(45) Date of Patent: Sep. 24, 2019

(54) PIXEL CIRCUIT AND DRIVING METHOD TO CONTROL CHARGING OR DISCHARGING OF PIXEL CAPACITOR

(71) Applicant: BOE TECHNOLOGY GROUP CO., LTD., Beijing (CN)

(72) Inventors: Yanfeng Wang, Beijing (CN); Guangliang Shang, Beijing (CN); Xiaoling Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 35 days.

(21) Appl. No.: 14/917,335

(22) PCT Filed: Aug. 27, 2015

(86) PCT No.: PCT/CN2015/088255
§ 371 (c)(1),
(2) Date: Mar. 8, 2016

(87) PCT Pub. No.: WO2016/107200
PCT Pub. Date: Jul. 7, 2016

(65) Prior Publication Data

US 2016/0210915 A1 Jul. 21, 2016

(30) Foreign Application Priority Data

Jan. 4, 2015 (CN) ..... 2015 1 0004106

(51) Int. Cl.
*G09G 3/36* (2006.01)

(52) U.S. Cl.
CPC ... *G09G 3/3659* (2013.01); *G09G 2300/0819* (2013.01); *G09G 2300/0852* (2013.01);
(Continued)

(58) Field of Classification Search
CPC ..... G09G 3/36; G09G 3/3614; G09G 3/3625; G09G 3/364; G09G 3/3644; G09G 3/3648;
(Continued)

(56) References Cited

U.S. PATENT DOCUMENTS 5,313,222 A * 5/1994 Lee ..... G09G 3/3677 345/100
6,476,786 B1 * 11/2002 Miyachi ..... G09G 3/3648 345/90

(Continued)

OTHER PUBLICATIONS

European Search Report dated Jun. 26, 2018.

*Primary Examiner* — Amit Chatly
*Assistant Examiner* — Nelson Lam
(74) *Attorney, Agent, or Firm* — Dilworth & Barrese, LLP.; Michael J. Musella

(57) ABSTRACT

A pixel circuit and driving method thereof and display apparatus are disclosed. The pixel circuit comprises: a selection circuit (P1), whose input terminal is connected to a selection signal terminal, a high level signal terminal and a low level signal terminal, configured to control charging or discharging of a pixel capacitor according to a digital signal input by the selection signal terminal; a charging/discharging circuit (P2), whose input terminal is connected to an output terminal of the selection circuit and a same row gate line signal terminal corresponding to the pixel capacitor and output terminal is connected to the pixel capacitor, configured to charge or discharge the pixel capacitor under the control of the selection circuit; and a pre-charging circuit (P3), whose input terminal is connected to a previous row gate line signal terminal corresponding to the pixel capacitor and output terminal is connected to the pixel capacitor,
(Continued)

configured to provide a reference voltage. This pixel circuit saves the digital-analogy conversion circuit and the analogy circuit part in the driving IC.

9 Claims, 5 Drawing Sheets

(52) U.S. Cl.
CPC ..... *G09G 2310/0251* (2013.01); *G09G 2310/0262* (2013.01)

(58) Field of Classification Search
CPC ..... G09G 3/3659; G09G 2310/0251; G09G 2310/0254; G09G 2310/0256; G09G 2310/0262
USPC ..... 345/87–104
See application file for complete search history.

(56) References Cited

U.S. PATENT DOCUMENTS 7,492,336 B2 * 2/2009 Kim ..... G09G 3/3241 315/169.3
2007/0118781 A1 5/2007 Kim
2008/0001893 A1 * 1/2008 Moon ..... G09G 3/3648 345/98
2008/0030439 A1 * 2/2008 Shin ..... G09G 3/3266 345/82
2008/0136983 A1 * 6/2008 Huang ..... G09G 3/3659 349/38
2009/0315823 A1 * 12/2009 Chen ..... G09G 3/3406 345/102
2012/0038597 A1 * 2/2012 Coulson ..... G09G 3/3659 345/204
2012/0182489 A1 * 7/2012 Wang ..... G02F 1/1368 349/38
2013/0069966 A1 * 3/2013 Zhao ..... G09G 3/3648 345/545
2013/0127924 A1 5/2013 Lee
2014/0198090 A1 7/2014 Park
2014/0368490 A1 * 12/2014 Yokonuma ..... G09G 3/3611 345/212
2015/0123958 A1 * 5/2015 Ting ..... G09G 3/3648 345/208

* cited by examiner

PIXEL CIRCUIT AND DRIVING METHOD TO CONTROL CHARGING OR DISCHARGING OF PIXEL CAPACITOR

TECHNICAL FIELD

The present disclosure relates to a pixel circuit, a driving method of the same and a display apparatus.

BACKGROUND

With the development of liquid crystal display technique, an increasing number of electronic devices adopt a liquid crystal display as a display screen. The liquid crystal display comprises a driving integrated circuit (hereinafter referred to as driving IC in short) and a pixel circuit. The driving IC provides an analogy signal for a pixel circuit, and charges a pixel capacitor in the pixel circuit through this analogy signal.

The driving IC comprises a digital circuit part, a digital-analogy conversion circuit part and an analogy circuit part, and is configured to charge the pixel capacitor in the pixel circuit after converting a digital signal into the analogy signal. However, the digital circuit part, the digital-analogy conversion part and the analogy circuit part in the driving IC always have relatively complicated structure and large size, such that the driving IC has a complicated structure entirely and large size, which results in increasing manufacturing cost of the driving IC.

SUMMARY

There are provided in several embodiments of the present disclosure a pixel circuit, a driving method of the same and a display apparatus, which are used to reduce manufacturing cost of a driving IC.

According to one aspect of the present disclosure, there is provided a pixel circuit. The pixel circuit comprises:

a selection circuit, whose input terminal is connected to a selection signal terminal, a high level signal terminal and a low level signal terminal, configured to control charging or discharging of a pixel capacitor according to a digital signal input by the selection signal terminal;

a charging/discharging circuit, whose input terminal is connected to an output terminal of the selection circuit and a same row gate line signal terminal corresponding to the pixel capacitor and output terminal is connected to the pixel capacitor, configured to charge or discharge the pixel capacitor under the control of the selection circuit; and a pre-charging circuit, whose input terminal is connected to a previous row gate line signal terminal corresponding to the pixel capacitor and output terminal is connected to the pixel capacitor, configured to provide a reference voltage for the pixel capacitor.

Optionally, the selection circuit comprises:

a first transistor T1, whose gate is connected to the selection signal terminal, source is connected to the high level signal terminal, and drain is connected to the charging/discharging circuit;

a second transistor T2, whose gate is connected to the selection signal terminal, drain is connected to the low level signal terminal, and source is connected to the charging/discharging circuit.

Further, the selection signal terminal comprises a first data line and a second data line, level polarities of digital signals on the first data line and the second data line are opposite, the gate of the first transistor T1 is connected to the first data line, and the gate of the second transistor T2 is connected to the second data line.

Optionally, the charging/discharging circuit comprises:

a third transistor T3, whose gate is connected to the same row gate line signal terminal corresponding to the pixel capacitor, source is connected to the drain of the first transistor T1 and the source of the second transistor T2, and drain is connected to the pixel capacitor.

Optionally, the pre-charging circuit comprises:

a fourth transistor T4, whose gate is connected to the previous row gate line signal terminal corresponding to the pixel capacitor, and both source and drain are connected to the pixel capacitor.

Further, both a digital signal on the first data line and a digital signal on the second data line are pulse digital signals whose duty ratio is adjustable.

Optionally, the selection circuit comprises:

a first transistor M1, whose gate is connected to the selection signal terminal, source is connected to the pixel capacitor, and drain is connected to the charging/discharging circuit;

a second transistor M2, whose gate is connected to the selection signal terminal, drain is connected to the low level signal terminal, and source is connected to the pre-charging circuit; and a fifth transistor M5, whose gate is connected to the selection signal terminal, source is connected to the high level signal terminal, and drain is connected to the pre-charging circuit.

Further, the selection signal terminal comprises a data line and a selection signal line, the data line is connected to the gate of the first transistor M1, and the selection signal line is connected to the gate of the second transistor M2 and the gate of the fifth transistor M5, and one of the second transistor M2 and the fifth transistor M5 is a P-type transistor, and the other thereof is a N-type transistor.

Optionally, the charging/discharging circuit comprises:

a third transistor M3, whose gate is connected to the same row gate line signal terminal corresponding to the pixel capacitor, source is connected to the drain of the first transistor M1, and drain is connected to the pixel capacitor.

Optionally, the pre-charging circuit comprises:

a fourth transistor M4, whose gate is connected to the previous row gate line signal terminal corresponding to the pixel capacitor, source is connected to the pixel capacitor, and drain is connected to the source of the second transistor M2 and the drain of the fifth transistor M5.

Further, a digital signal on the data line is a pulse digital signal whose duty ratio is adjustable.

On the other hand, there is provided a driving method of a pixel circuit, comprising:

receiving an input signal of a previous row gate line signal terminal corresponding to a pixel capacitor, and providing a reference voltage for the pixel capacitor according to the input signal of the previous row gate line signal terminal by a pre-charging circuit;

receiving a digital signal of a selection signal terminal, and determining that a charging/discharging circuit charges or discharges according to the digital signal of the selection signal terminal by a selection circuit; and receiving an input signal of a same row gate line signal terminal corresponding to the pixel capacitor, and charging or discharging the pixel capacitor according to the input signal of the same row gate line signal terminal by the charging/discharging circuit.

Optionally, that a pre-charging circuit receives an input signal of a previous row gate line signal terminal corresponding to a pixel capacitor, and provides a reference voltage for the pixel capacitor according to the input signal of the previous row gate line signal terminal, comprises:

a gate of a fourth transistor T4 receives the input signal of the previous row gate line signal terminal corresponding to the pixel capacitor; and when the input signal of the previous row gate line signal terminal is a high level signal, the fourth transistor T4 is turned on to provide the reference voltage for the pixel capacitor.

Optionally, the selection signal terminal comprises a first data line and a second data line; that a selection circuit receives a digital signal of a selection signal terminal, and determines a charging/discharging circuit charges or discharges according to the digital signal of the selection signal terminal, comprises:

when a digital signal on the first data line is the high level signal, a digital signal on the second data line is a low level signal, the first transistor T1 is turned on, the second transistor is turned off, and it is determined the charging/discharging circuit charges; and when the digital signal on the first data line is the low level signal, the digital signal on the second data line is the high level signal, the first transistor T1 is turned off, the second transistor is turned on, and it is determined the charging/discharging circuit discharges.

Optionally, that a charging/discharging circuit receives an input signal of a same row gate line signal terminal corresponding to the pixel capacitor, and charges or discharges the pixel capacitor according to the input signal of the same row gate line signal terminal, comprises:

a gate of a third transistor T3 receives the input signal of the same row gate line signal terminal corresponding to the pixel capacitor; and when the input signal of the same row gate line signal terminal is the high level signal, the third transistor T3 is turned on to charge or discharge the pixel capacitor.

Further, both a digital signal on the first data line and a digital signal on the second data line are pulse digital signals whose duty ratio is adjustable.

Optionally, that a pre-charging circuit receives an input signal of a previous row gate line signal terminal corresponding to a pixel capacitor, and provides a reference voltage for the pixel capacitor according to the input signal of the previous row gate line signal terminal, comprises:

a fourth transistor M4 receives the input signal of the previous row gate line signal terminal corresponding to the pixel capacitor; and when the input signal of the previous row gate line signal terminal is the high level signal, the fourth transistor M4 is turned on.

Optionally, the selection signal terminal comprises a data line and a selection signal line; a second transistor M2 is a N-type transistor, and a fifth transistor M5 is a P-type transistor; that the selection circuit receives the digital signal of the selection signal terminal, and determines that the charging/discharging circuit charges or discharges according to the digital signal of the selection signal terminal, comprises:

when an input signal on the selection signal line is the high level signal, the second transistor M2 is turned off, the fifth transistor M5 is turned on, and it is determined the charging/discharging circuit charges;

when the input signal on the selection signal line is the low level signal, the second transistor M2 is turned on, the fifth transistor M5 is turned off, and it is determined that the charging/discharging circuit discharges; and when the digital signal on the data line is the high level signal, a source and drain of a first transistor M1 are turned on.

Optionally, it further comprises:

when the input signal on the selection signal line is the high level signal, the second transistor M2 is turned off, and the fifth transistor M5 is turned on, to pre-charge the pixel capacitor; and when the input signal on the selection signal line is the low level signal, the second transistor M2 is turned on, and the fifth transistor M5 is turned off, to pre-discharge the pixel capacitor.

Optionally, that a charging/discharging circuit receives an input signal of a same row gate line signal terminal corresponding to the pixel capacitor, and charges or discharges the pixel capacitor according to the input signal of the same row gate line signal terminal, comprises:

a gate of a third transistor M3 receives the input signal of the same row gate line signal terminal corresponding to the pixel capacitor; and when the input signal of the same row gate line signal terminal is the high level signal, the pixel capacitor is charged or discharged.

Further, the digital signal on the data line is a pulse digital signal whose duty ratio is adjustable.

On the other hand, there is provided a display apparatus, comprising the pixel circuit described above.

In the pixel circuit and the driving method of the same and the display apparatus provided in the embodiments of the present disclosure, the pixel circuit comprises the selection circuit, the charging/discharging circuit and the pre-charging circuit. The selection circuit is capable of controlling the charging/discharging circuit to charge or discharge the pixel capacitor according to the digital signal input by a connected selection signal terminal, so that the digital signal provided by the driving IC can be utilized directly to charge the pixel circuit, which saves the digital-analogy conversion circuit and the analogy circuit part in the driving IC, simplifies the structure of the driving IC, and at the same time reduces the size of the driving IC, thereby reducing the manufacturing cost of the driving IC.

DETAILED DESCRIPTION

In order to further describe a pixel circuit and a driving method of the same and a display apparatus provided in embodiments of the present disclosure, detailed description is provided below by combining with the figures of the specification.

First Embodiment

Figure 1:
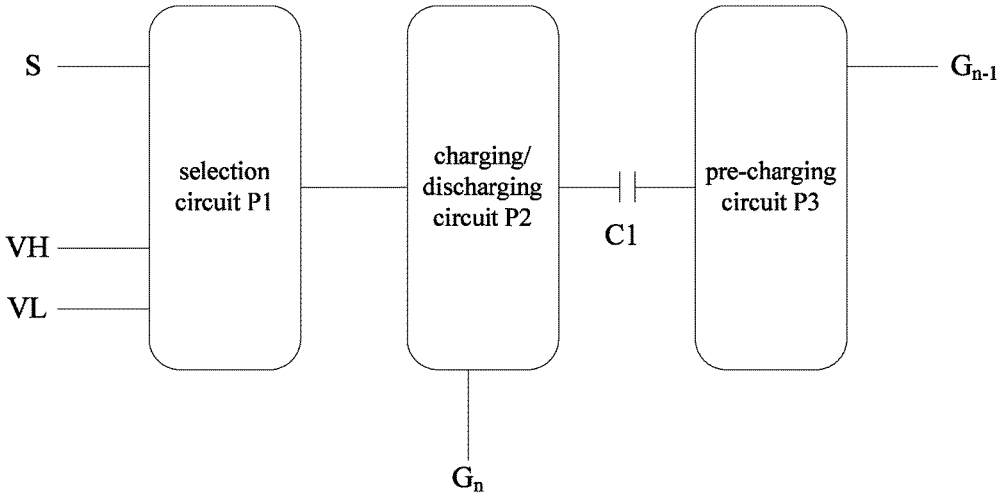
FIG. 1 is a schematic diagram of a structure of a pixel circuit provided in a first embodiment of the present disclosure.

FIG. 1 shows a schematic diagram of a structure of a pixel circuit provided in a first embodiment of the present disclosure. Referring to FIG. 1, the pixel circuit comprises a selection circuit P1, a charging/discharging circuit P2 and a pre-charging circuit P3. In FIG. 1, an input terminal of the selection circuit P1 is connected to a selection signal terminal S, a high level signal terminal VH and a low level signal terminal VL, and an output terminal thereof is connected to a control terminal of the charging/discharging circuit 2. The selection circuit P1 is configured to control the charging/discharging circuit P2 to charge or discharge the pixel capacitor C1 according to a digital signal input by the selection signal terminal S. An input terminal of the charging/discharging circuit P2 is connected to a same row gate line signal terminal Gn corresponding to the pixel capacitor C1, and an output terminal thereof is connected to one terminal of the pixel capacitor C1. The charging/discharging circuit P2 is configured to charge or discharge the pixel capacitor C1 under the control of the selection circuit P1. An input terminal of the pre-charging circuit P3 is connected to a previous row gate line signal terminal $G_{n-1}$ corresponding to the pixel capacitor C1, and an output terminal thereof is connected to another terminal of the pixel capacitor C1. The pre-charging circuit P3 is configured to provide the reference voltage for the pixel capacitor C1. Herein, the selection signal terminal S outputs a digital signal. Exemplarily, one or more resistors for dividing a voltage can also be arranged in the pixel circuit.

It needs to note that when a pre-charging circuit in a current row of pixel circuit is pre-charging a pixel capacitor of a current row, a charging/discharging circuit in a previous row of pixel circuit is charging or discharging a pixel capacitor of a previous row.

Figure 2:
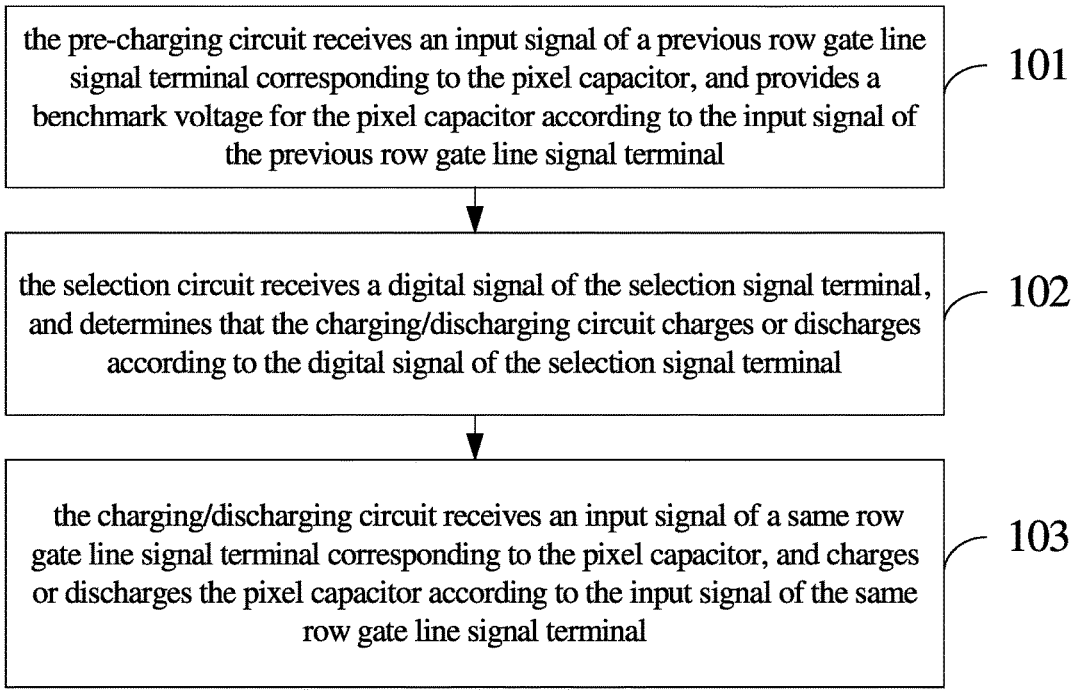
FIG. 2 is a flow diagram of a driving method of a pixel circuit provided in a first embodiment of the present disclosure.

FIG. 2 shows a flow diagram of a driving method of a pixel circuit provided in a first embodiment of the present disclosure. Referring to FIG. 2, there is further provided in the embodiment of the present disclosure the driving method of the pixel circuit as shown in FIG. 1. This method comprises following processes:

In step 101, the pre-charging circuit receives an input signal of a previous row gate line signal terminal corresponding to the pixel capacitor, and provides a reference voltage for the pixel capacitor according to the input signal of the previous row gate line signal terminal.

In step 102, the selection circuit receives a digital signal of the selection signal terminal, and determines that the charging/discharging circuit charges or discharges according to the digital signal of the selection signal terminal.

In step 103, the charging/discharging circuit receives an input signal of a same row gate line signal terminal corresponding to the pixel capacitor, and charges or discharges the pixel capacitor according to the input signal of the same row gate line signal terminal.

There are provided in the embodiments of the present disclosure the pixel circuit and the driving method of the same. The pixel circuit comprises the selection circuit, the charging/discharging circuit and the pre-charging circuit. The selection circuit is capable of controlling the charging/discharging circuit to charge or discharge the pixel capacitor according to the digital signal input by a connected selection signal terminal, so that the digital signal provided by the driving IC can be utilized directly to charge the pixel circuit, which saves the digital-analogy conversion circuit and the analogy circuit part in the driving IC, simplifies the structure of the driving IC, and at the same time reduces the size of the driving IC, thereby reducing the manufacturing cost of the driving IC.

Second Embodiment

Figure 3:
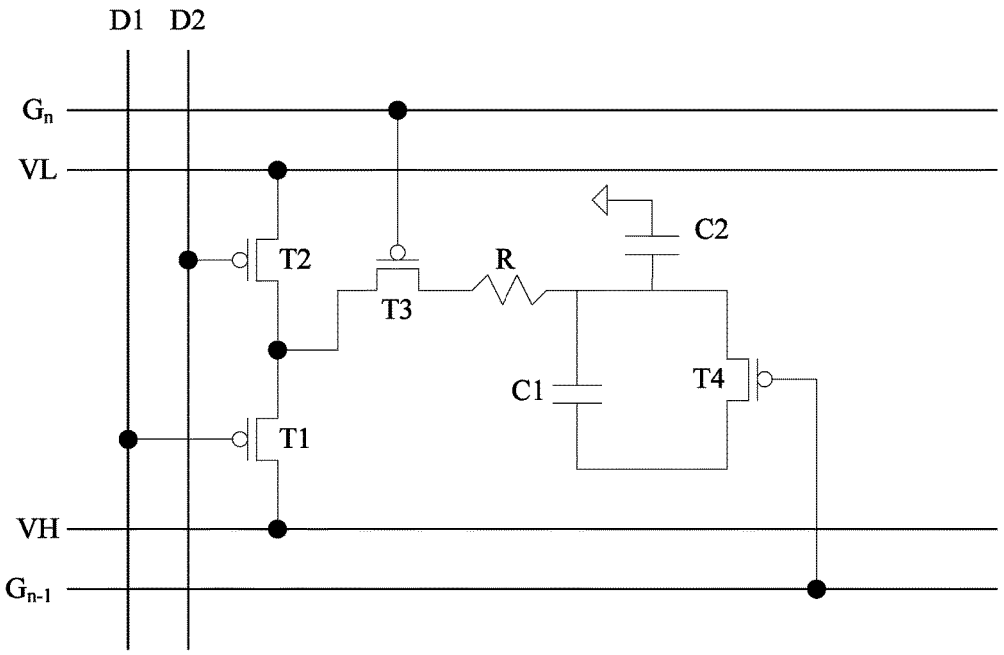
FIG. 3 is a schematic diagram of a structure of a pixel circuit provided in a second embodiment of the present disclosure.

FIG. 3 shows a schematic diagram of a structure of a pixel circuit provided in a second embodiment of the present disclosure. Further, Referring to FIG. 3, the selection circuit P1 in the pixel circuit provided in the embodiment of the present disclosure comprises a first transistor T1 and a second transistor T2. The charging/discharging circuit P2 comprises a third transistor T3, the pre-charging circuit P3 comprises a fourth transistor T4, and C2 is a liquid crystal equivalent capacitor. A gate of the first transistor T1 is connected to a first data line D1, a source thereof is connected to a high level signal terminal VH, and a drain thereof is connected to the charging/discharging circuit P2. A gate of the second transistor T2 is connected to a second data line D2, a drain thereof is connected to a low level signal terminal VL, and a source thereof is connected to the charging/discharging circuit P2. A gate of the third transistor T3 is connected to the same row of gate line signal terminal $G_n$ corresponding to pixel capacitor C1, a source thereof is connected to the drain of the first transistor T1 and the source of the second transistor T2, and a drain thereof is connected to the pixel capacitor C1. A gate of the fourth transistor T4 is connected to the previous row of gate line signal terminal $G_{n-1}$ corresponding to the pixel capacitor C1, and a source and a drain thereof are connected to two terminals of the pixel capacitor C1 respectively.

Exemplarily, one or more resistors can be arranged in the above pixel circuit. In FIG. 3, the one or more resistors are equivalent to an equivalent resistor R, which is connected to the pixel capacitor C1. The selection signal terminal S can comprise the first data line D1 and the second data line D2. Level polarities of digital signals on the first data line D1 and the second data line D2 are opposite. For example, when the digital signal on the first data line D1 is the high level signal, the digital signal on the second data line D2 is the low level signal; when the digital signal on the first data line D1 is the low level signal, the digital signal on the second data line D2 is the high level signal.

Figure 4:
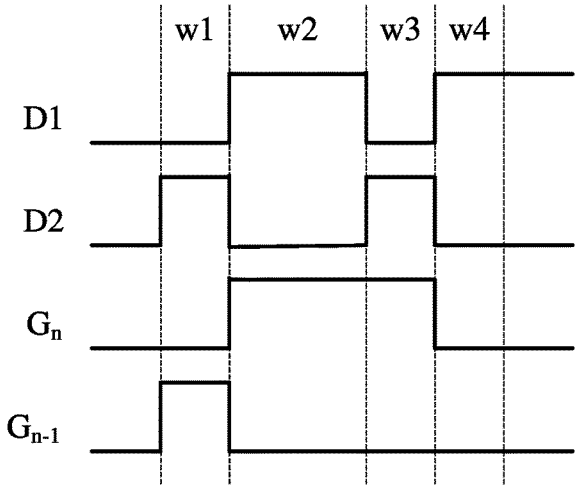
FIG. 4 is a signal timing diagram of the pixel circuit provided in FIG. 3.

FIG. 4 is a signal timing diagram of the pixel circuit provided in FIG. 3. By combing with the signal timing diagram as shown in FIG. 4, operating principle of the pixel circuit as shown in FIG. 3 is described below by taking that the first transistor T1 to the fourth transistor T4 are N-type transistors as an example. The signal timing diagram as shown in FIG. 4 can be divided into 4 phases, which are a pre-charging phase w1, a charging phase w2, a discharging phase w3, and a charging ending phase w4, respectively.

In the pre-charging phase w1, the signal of the previous row gate line signal terminal $G_{n-1}$ is the high level signal, and the fourth transistor T4 is turned on to pre-charge the pixel capacitor C1 until the voltage of the pixel capacitor C1 reaches the reference voltage. The signal of the same row gate line signal terminal $G_n$ corresponding to the pixel capacitor C1 is the low level signal, and the third transistor T3 is turned off. Polarity of the digital signal on the first data line D1 is not limited, and this digital signal may be the high level signal or may be the low level signal. Polarity of the digital signal on the second data line D2 is opposite to the polarity of the digital signal on the first data line D1.

In the charging phase w2, the signal of the previous row gate line signal $G_{n-1}$ is the low level signal, and the fourth transistor T4 is turned off, pre-charging has already completed, the signal of the same row gate line signal terminal $G_n$ corresponding to the pixel capacitor C1 is the high level signal, and the third transistor T3 is turned on, the selection circuit P1 is connected with the charging/discharging circuit P2. The digital signal on the first data line D1 is the high level signal, the first transistor T1 is turned on, the digital signal on the second data line D2 is the low level signal, and the second transistor T2 is turned off, and the high level signal terminal VH charges the pixel capacitor C1.

In the discharging phase w3, the signal of the same row gate line signal terminal $G_n$ corresponding to the pixel capacitor C1 is the high level signal, the third transistor T3 is turned on, and the selection circuit P1 is connected with the charging/discharging circuit P2. The digital signal on the first data line D1 is the low level signal, the first transistor T1 is turned off, the digital signal on the second data line D2 is the high level signal, the second transistor T2 is turned on, and the low level signal terminal VL discharges the pixel capacitor C1.

In the charging ending phase w4, the signal of the same row gate line signal terminal $G_n$ corresponding to the pixel capacitor C1 is the low level signal, the third transistor T3 is turned off, and the selection circuit P1 is disconnected from the charging/discharging circuit P2 to stop charging or discharging the pixel capacitor.

In the above embodiment, both the digital signal on the first data line D1 and the digital signal on the second data line D2 are pulse digital signals whose duty ratio is adjustable, that is, a period of time during which the digital signal on the first data line D1 is at a high level and a period of time during which the digital signal on the first data line D1 is at a low level are adjustable, so that time for charging or discharging the pixel capacitor C1 can be adjusted, and further the voltage of the pixel capacitor C1 is adjusted.

Figure 5:
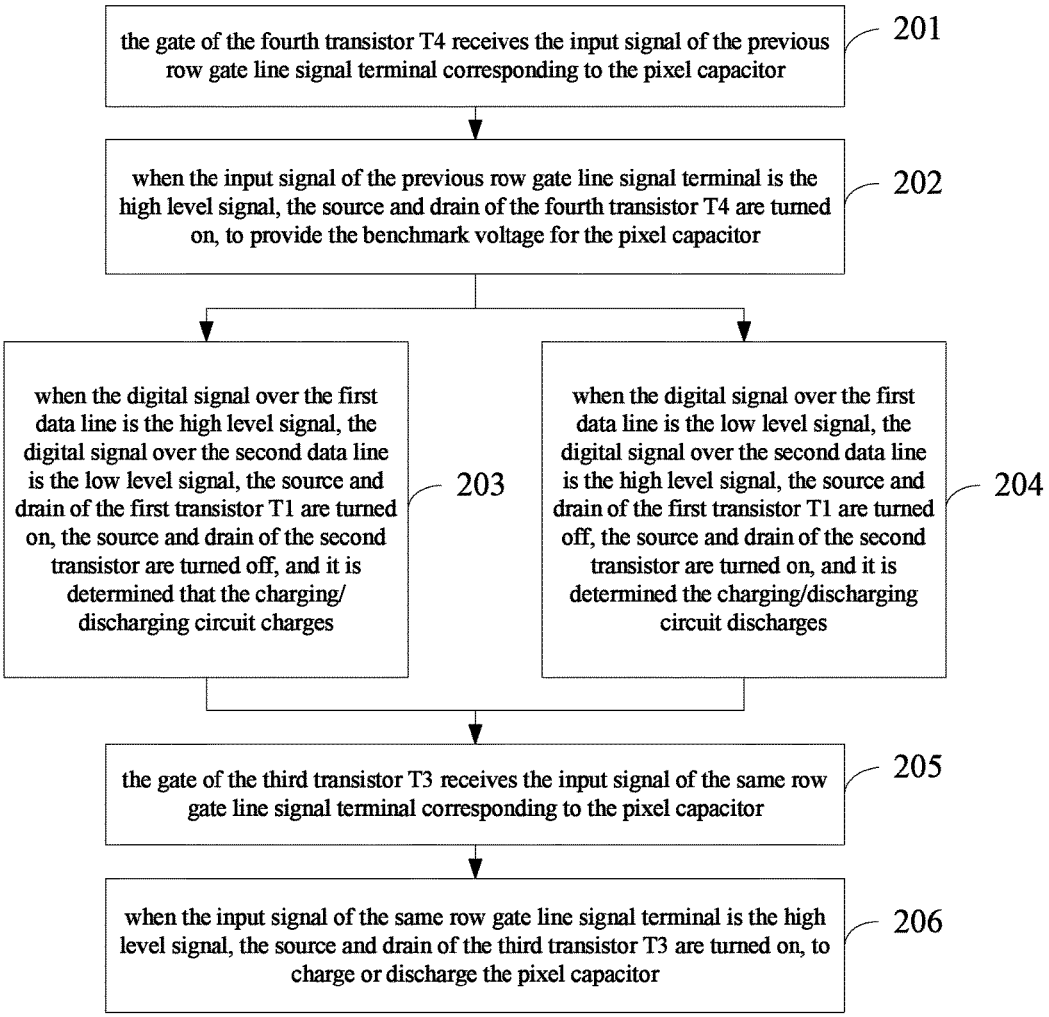
FIG. 5 is a flow diagram of a driving method of a pixel circuit provided in a second embodiment of the present disclosure.

FIG. 5 shows a flow diagram of a driving method of a pixel circuit provided in the second embodiment of the present disclosure. Referring to FIG. 5, there is further provided in the embodiment of the present disclosure a driving method of the pixel circuit as shown in FIG. 3. This method comprises following processes:

In step 201, the gate of the fourth transistor T4 receives the input signal of the previous row gate line signal terminal corresponding to the pixel capacitor C1.

In step 202, when the input signal of the previous row gate line signal terminal is the high level signal, the fourth transistor T4 is turned on, to provide the reference voltage for the pixel capacitor.

In step 203, when the digital signal on the first data line is the high level signal, the digital signal on the second data line is the low level signal, the first transistor T1 is turned on, the second transistor is turned off, and it is determined that the charging/discharging circuit charges.

In step 204, when the digital signal on the first data line is the low level signal, the digital signal on the second data line is the high level signal, the first transistor T1 is turned off, the second transistor is turned on, and it is determined the charging/discharging circuit discharges.

In step 205, the gate of the third transistor T3 receives the input signal of the same row gate line signal terminal corresponding to the pixel capacitor C1.

In step 206, when the input signal of the same row gate line signal terminal is the high level signal, the third transistor T3 is turned on, to charge or discharge the pixel capacitor.

In the embodiment as shown in FIG. 5, if it is determined in step 203 that the charging/discharging circuit charges the pixel capacitor C1, then the pixel capacitor C1 is charged in step 206; if it is determined in step 204 that the charging/discharging circuit discharges the pixel capacitor C1, then the pixel capacitor C1 is discharged in step 206.

There are provided in the embodiments of the present disclosure the pixel circuit and the driving method of the same. The pixel circuit comprises the selection circuit, the charging/discharging circuit and the pre-charging circuit. The selection circuit is capable of controlling the charging/discharging circuit to charge or discharge the pixel capacitor according to the digital signal input by a connected selection signal terminal, so that the digital signal provided by the driving IC can be utilized directly to charge the pixel circuit, which saves the digital-analogy conversion circuit and the analogy circuit part in the driving IC, simplifies the structure of the driving IC, and at the same time reduces the size of the driving IC, thereby reducing the manufacturing cost of the driving IC. At the same time, the time for charging or discharging the pixel capacitor can be adjusted by adjusting the duty ratio of the digital signals on the first data line and the second data line, so as to adjust the voltage value of the pixel capacitor.

Third Embodiment

Figure 6:
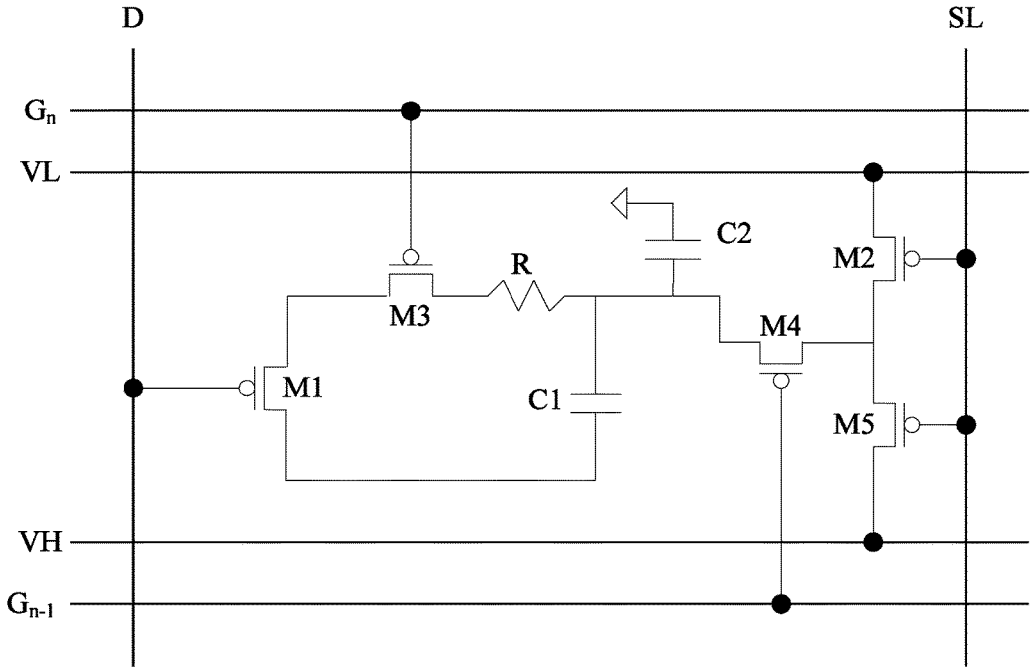
FIG. 6 is a schematic diagram of a structure of a pixel circuit provided in a third embodiment of the present disclosure.

FIG. 6 shows a schematic diagram of a structure of a pixel circuit provided in a third embodiment of the present disclosure. Further, Referring to FIG. 6, the selection circuit P1 in the pixel circuit comprises a first transistor M1, a second transistor M2, and a fifth transistor M5. The charging/discharging circuit P2 comprises a third transistor M3, the pre-charging circuit P3 comprises a fourth transistor M4, and C2 is a liquid crystal equivalent capacitor. A gate of the first transistor M1 is connected to the selection signal terminal S (not shown), a source thereof is connected to the pixel capacitor C1, and a drain thereof is connected to the charging/discharging circuit P2. A gate of the second transistor M2 is connected to the selection signal terminal S (not shown), a drain thereof is connected to the low level signal terminal VL, and a source thereof is connected to the charging/discharging circuit P3. A gate of the fifth transistor M5 is connected to the selection signal terminal S (not shown), a source thereof is connected to the high level signal terminal VH, and a drain thereof is connected to the pre-charging circuit P3. A gate of the third transistor M3 is connected to the same row gate line signal terminal $G_n$ corresponding to pixel capacitor C1, a source thereof is connected to the drain of the first transistor M1, and a drain thereof is connected to the pixel capacitor C1. A gate of the fourth transistor M4 is connected to the previous row gate line signal terminal $G_{n-1}$ corresponding to the pixel capacitor C1, and a source thereof is connected to the pixel capacitor C1, and a drain thereof is connected to the source of the second transistor M2 and the drain of the fifth transistor M5.

Exemplarily, one or more resistors can be arranged in the pixel circuit. In FIG. 6, the one or more resistors are equivalent to an equivalent resistor R, which is connected to the pixel capacitor C1. The selection signal terminal S can comprise a data line D and a selection signal line SL. The data line D is connected to the gate of the first transistor M1, and the selection signal line SL is connected to the gate of the second transistor M2 and the gate of the fifth transistor M5. One of the second transistor M2 and the fifth transistor M5 is a N-type transistor, and the other thereof is a P-type transistor, for example, when the second transistor M2 is the N-type transistor, the fifth transistor M5 is the P-type transistor; when the second transistor M2 is the P-type transistor, the fifth transistor M5 is the N-type transistor.

Figure 7:
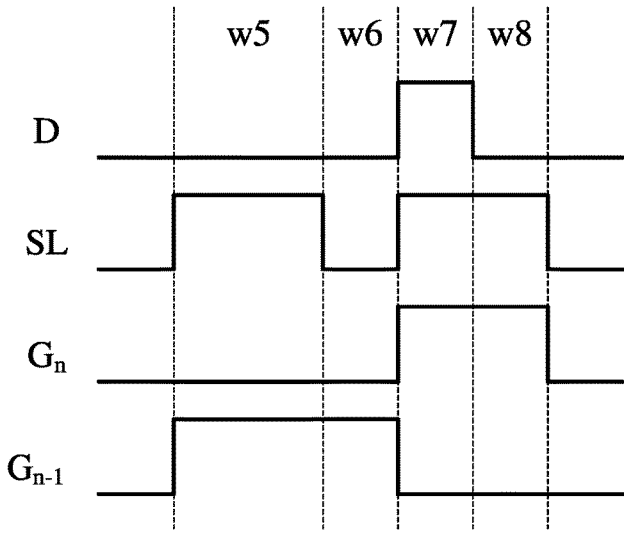
FIG. 7 is a signal timing diagram of the pixel circuit provided in FIG. 6.

FIG. 7 shows a signal timing diagram of the pixel circuit provided in FIG. 6. By combing with the signal timing diagram as shown in FIG. 7, operating principle of the pixel circuit as shown in FIG. 6 is described by taking the second transistor M2 being the P-type transistor and the fifth transistor M5 being the N-type transistor as an example. Herein, the signal timing diagram as shown in FIG. 7 can be divided into 4 phases, i.e., a pre-charging phase w15, a pre-discharging phase w6, a charging/discharging phase w7 and a charging/discharging ending phase w8.

In the pre-charging phase w5, the signal of the previous row gate line signal terminal $G_{n-1}$ is the high level signal, the fourth transistor M4 is turned on, the signal on the selection signal line SL is the high level signal, the second transistor M2 is turned off, and the fifth transistor M5 is turned on to pre-charge the pixel capacitor C1, the signal of the same row gate line signal terminal $G_n$ corresponding to the pixel capacitor C1 is the low level signal, and the third transistor M3 is turned off. Polarity of the digital signal on the data line is not limited, and this digital signal may be the high level signal or may be the low level signal.

In the pre-discharging phase w6, the signal of the previous row gate line signal terminal $G_{n-1}$ is the high level signal, the fourth transistor M4 is turned on, the signal of the selection signal line SL is the low level signal, the second transistor M2 is turned on, and the fifth transistor M5 is turned off to pre-discharge the pixel capacitor C1 until the reference voltage is reached. The signal of the same row gate line signal terminal $G_n$ corresponding to the pixel capacitor C1 is the low level signal, and the third transistor M3 is turned off. Polarity of the digital signal on the data line is not limited, and this digital signal may be the high level signal, or may be the low level signal.

In the charging/discharging phase w7, the signal of the previous row gate line signal terminal $G_{n-1}$ is the low level signal, the fourth transistor T4 is turned off, pre-charging (including processes of pre-charging and/or pre-discharging) has already completed, the signal of the same row gate line signal terminal $G_n$ corresponding to the pixel capacitor C1 is the high level signal, the selection circuit P1 is connected with the charging/discharging circuit P2, the digital signal on the data line D is the high level signal, and the first transistor M1 is turned on to charge or discharge the pixel capacitor C1.

In the charging/discharging ending phase w8, the signal on the data line D is the low level signal, the first transistor M1 is turned off, and the selection circuit P1 is disconnected from the charging/discharging circuit P2 to stop charging or discharging the pixel capacitor.

Figure 8:
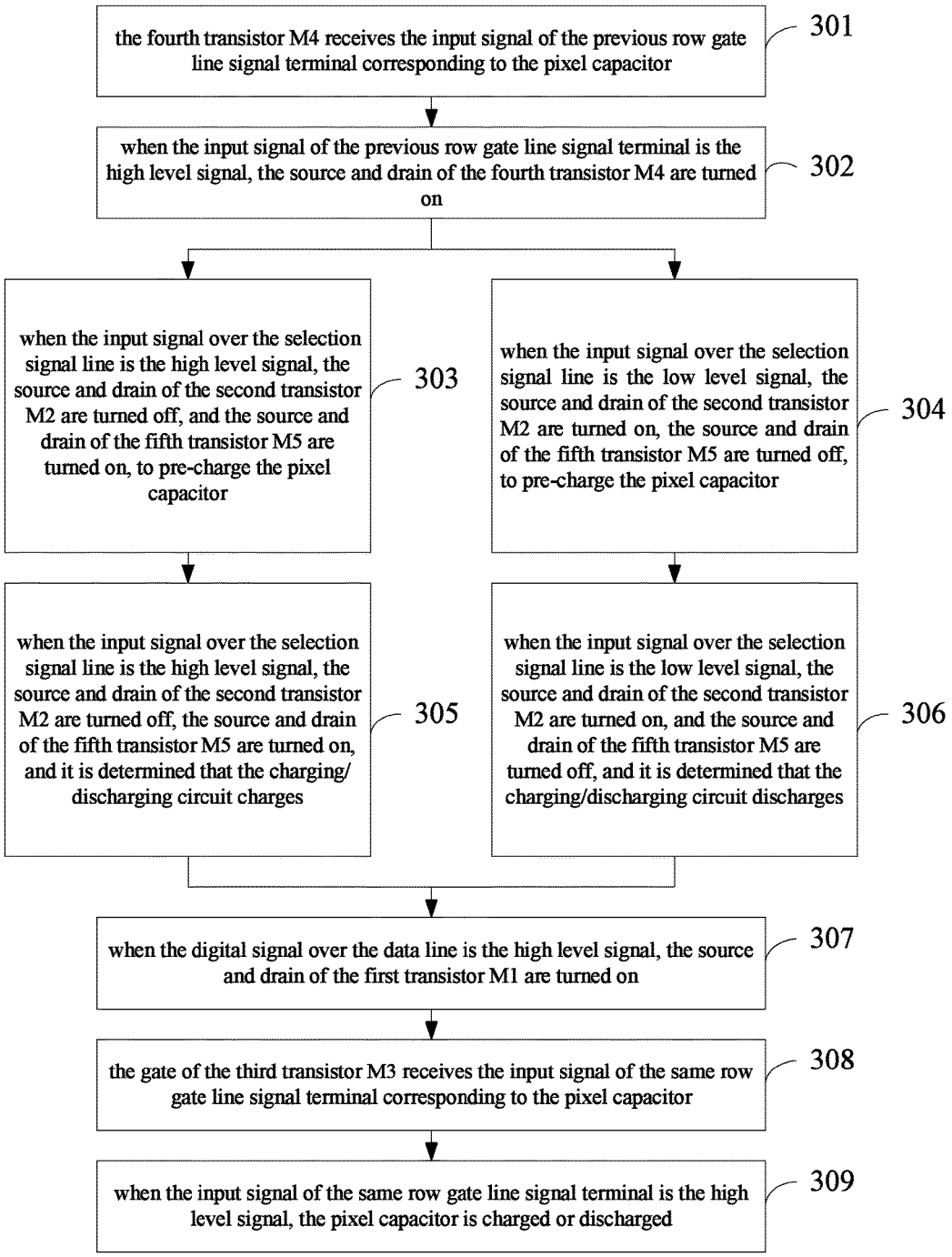
FIG. 8 is a flow diagram of a driving method of a pixel circuit provided in a third embodiment of the present disclosure.

Alternatively, the digital signal on the data line D is a pulse digital signal whose duty ratio is adjustable, that is, a period of time during which the digital signal on the data line D is at a high level and a period of time during which the digital signal on the data line D is at a low level are adjustable, so that time for charging or discharging the pixel capacitor C1 can be adjusted, and further the voltage of the pixel capacitor C1 is adjusted. FIG. 8 shows a flow diagram of a driving method of a pixel circuit provided in the third embodiment of the present disclosure. Referring to FIG. 8, the driving method of the pixel circuit as shown in FIG. 6 comprises following processes:

In step 301, the fourth transistor M4 receives the input signal of the previous row gate line signal terminal corresponding to the pixel capacitor C1.

In step 302, when the input signal of the previous row gate line signal terminal is the high level signal, the fourth transistor M4 is turned on.

In step 303, when the input signal on the selection signal line is the high level signal, the second transistor M2 is turned off, and the fifth transistor M5 is turned on, to pre-charge the pixel capacitor.

In step 304, when the input signal on the selection signal line is the low level signal, the second transistor M2 is turned on, the fifth transistor M5 is turned off, to pre-charge the pixel capacitor.

In step 305, when the input signal on the selection signal line is the high level signal, the second transistor M2 is turned off, the fifth transistor M5 is turned on, and it is determined that the charging/discharging circuit charges.

In step 306, when the input signal on the selection signal line is the low level signal, the second transistor M2 is turned on, and the fifth transistor M5 is turned off, and it is determined that the charging/discharging circuit discharges.

In step 307, when the digital signal on the data line is the high level signal, the first transistor M1 is turned on.

In step 308, the gate of the third transistor M3 receives the input signal of the same row gate line signal terminal corresponding to the pixel capacitor.

In step 309, when the input signal of the same row gate line signal terminal is the high level signal, the pixel capacitor is charged or discharged.

There are provided in the embodiments of the present disclosure the pixel circuit and the driving method of the same. The pixel circuit comprises the selection circuit, the charging/discharging circuit and the pre-charging circuit. The selection circuit is capable of controlling the charging/discharging circuit to charge or discharge the pixel capacitor according to the digital signal input by a connected selection signal terminal, so that the digital signal provided by the driving IC can be utilized directly to charge the pixel circuit, which omits the digital-analogy conversion circuit and the analogy circuit part in the driving IC, simplifies the structure of the driving IC, and at the same time reduces the size of the driving IC, thereby reducing the manufacturing cost of the driving IC. At the same time, the time for charging or discharging the pixel capacitor can be adjusted by adjusting the duty ratio of the digital signals on the first data line and the second data line, so as to adjust the voltage value of the pixel capacitor.

There is further provided in an embodiment of the present disclosure a display apparatus, comprising any of the pixel circuits described above. The display apparatus can be any product or means having a display function such as an electronic paper, a mobile phone, a tablet computer, a TV set, a display, a notebook computer, a digital photo frame, a navigator or the like.

In the description of the above implementations, specific features, structures, materials or characteristics can be combined in an appropriate manner in any one or more embodiments or examples.

The above descriptions are just specific implementations of the present disclosure, but the protection scope of the present disclosure is not limited thereto. Any alternation or replacement that can be easily conceived by those skilled in the art who are familiar with the technical field within the technical scope of the present disclosure shall be covered within the protection scope of the present disclosure. Therefore, the protection scope of the present disclosure shall be subjected to the protection scope of the claims.

The present application claims the priority of a Chinese patent application No. 201510004106.3 filed on Jan. 4, 2015. Herein, the content disclosed by the Chinese patent application is incorporated in full by reference as a part of the present disclosure.

What is claimed is:

1. A pixel circuit, comprising:

a selection circuit, whose input terminal is connected to a selection signal terminal, a high level signal terminal and a low level signal terminal, configured to control charging or discharging of a pixel capacitor according to a digital signal input by the selection signal terminal;

a charging/discharging circuit, whose input terminal is connected to an output terminal of the selection circuit and a same row gate line signal terminal corresponding to the pixel capacitor and output terminal is connected to the pixel capacitor, configured to charge or discharge the pixel capacitor under the control of the selection circuit; and a pre-charging circuit, whose input terminal is connected to a previous row gate line signal terminal corresponding to the pixel capacitor and output terminal is connected to the pixel capacitor, configured to provide a reference voltage for the pixel capacitor, wherein the selection circuit comprises:

a first transistor, whose gate is connected to the selection signal terminal, source is connected to the high level signal terminal, and drain is connected to the charging/discharging circuit; and a second transistor, whose gate is connected to the selection signal terminal, drain is connected to the low level signal terminal, and source is connected to the charging/discharging circuit, wherein the selection signal terminal comprises a first data line and a second data line, level polarities of digital signals on the first data line and the second data line are maintained opposite during a pre-charging phase, a charging phase and a discharging phase, the gate of the first transistor is connected to the first data line, and the gate of the second transistor is connected to the second data line, so that when a digital signal on the first data line is a high level signal, and a digital signal on the second data line is a low level signal, the first transistor is turned on, the second transistor is turned off, and the charging/discharging circuit charges the pixel capacitor; and when the digital signal on the first data line is the low level signal, and the digital signal on the second data line is the high level signal, the first transistor is turned off, the second transistor is turned on, and the charging/discharging circuit discharges the pixel capacitor.

2. The pixel circuit according to claim 1, wherein the charging/discharging circuit comprises:

a third transistor, whose gate is connected to the same row gate line signal terminal corresponding to the pixel capacitor, source is connected to the drain of the first transistor and the source of the second transistor, and drain is connected to the pixel capacitor.

3. The pixel circuit according to claim 1, wherein the pre-charging circuit comprises:

a fourth transistor, whose gate is connected to the previous row gate line signal terminal corresponding to the pixel capacitor, and both source and drain are connected to the pixel capacitor.

4. The pixel circuit according to claim 1, wherein both a digital signal on the first data line and a digital signal on the second data line are pulse digital signals whose duty ratio is adjustable.

5. A display apparatus, comprising the pixel circuit according to claim 1.

6. A driving method of a pixel circuit, comprising following a sequence of steps:

receiving an input signal of a previous row gate line signal terminal corresponding to a pixel capacitor, and providing a reference voltage for the pixel capacitor according to the input signal of the previous row gate line signal terminal by a pre-charging circuit;

receiving a digital signal of a selection signal terminal, and controlling charging or discharging of the pixel capacitor according to the digital signal of the selection signal terminal by a selection circuit; and receiving an input signal of a same row gate line signal terminal corresponding to the pixel capacitor, and charging or discharging the pixel capacitor according to the input signal of the same row gate line signal terminal by a charging/discharging circuit, wherein the selection signal terminal comprises a first data line and a second data line, level polarities of digital signals on the first data line and the second data line are maintained opposite during a pre-charging phase, a charging phase and a discharging phase, the selection circuit comprises a first transistor and a second transistor, and the pre-charging circuit comprises a fourth transistor, receiving a digital signal of a selection signal terminal, and controlling charging or discharging of the pixel capacitor according to the digital signal of the selection signal terminal by a selection circuit, comprises:

when a digital signal on the first data line is a high level signal, and a digital signal on the second data line is a low level signal, the first transistor is turned on, the second transistor is turned off, and the charging/discharging circuit charges the pixel capacitor; and when the digital signal on the first data line is the low level signal, and the digital signal on the second data line is the high level signal, the first transistor is turned off, the second transistor is turned on, and the charging/discharging circuit discharges the pixel capacitor.

7. The driving method of the pixel circuit according to claim 6, wherein that receiving an input signal of a previous row gate line signal terminal corresponding to a pixel capacitor, and providing a reference voltage for the pixel capacitor according to the input signal of the previous row gate line signal terminal by a pre-charging circuit, comprises:

receiving by a gate of the fourth transistor the input signal of the previous row gate line signal terminal corresponding to the pixel capacitor; and when the input signal of the previous row gate line signal terminal is a high level signal, the fourth transistor is turned on, to provide the reference voltage for the pixel capacitor.

8. The driving method of the pixel circuit according to claim 6, wherein that receiving an input signal of a same row gate line signal terminal corresponding to the pixel capacitor, and charging or discharging the pixel capacitor according to the input signal of the same row gate line signal terminal by a charging/discharging circuit, comprises:

receiving by a gate of a third transistor the input signal of the same row gate line signal terminal corresponding to the pixel capacitor; and when the input signal of the same row gate line signal terminal is the high level signal, turning on the third transistor to charge or discharge the pixel capacitor.

9. The driving method of the pixel circuit according to claim 6, wherein both a digital signal on the first data line and a digital signal on the second data line are pulse digital signals whose duty ratio is adjustable.

* * * * *